United States Patent [19]

Park

[11] Patent Number: 5,039,906

[45] Date of Patent: Aug. 13, 1991

[54] ELECTRON GUN FOR COLOR CATHODE RAY TUBE

[75] Inventor: In-gyu Park, Kyuggi, Rep. of Korea

[73] Assignee: Samsung Electron Devices Co., Ltd., Kyunggi, Rep. of Korea

[21] Appl. No.: 520,188

[22] Filed: May 8, 1990

[51] Int. Cl.[5] ..... H01J 29/51; H01J 29/62

[52] U.S. Cl. ..... 313/414; 313/412

[58] Field of Search ..... 313/414, 412

[56] References Cited

U.S. PATENT DOCUMENTS 4,528,476 7/1985 Alig ..... 313/414 X 4,833,365 5/1989 Shirai et al. ..... 313/412 X

*Primary Examiner*—Palmer C. DeMeo

*Attorney, Agent, or Firm*—Finnegan, Henderson, Farabow, Garrett & Dunner

[57] ABSTRACT

An electron gun for a cathode ray tube which comprises a triode, a bipotential main lens, and a unipotential prefocus lens, wherein the diameters of the beam passing holes of the middle electrode of the unipotential prefocus lens are greater than the diameters of the beam passing holes of the electrodes which are disposed upstream and downstream of the middle electrode, and the outer beam passing holes of the middle electrode are disposed outwardly eccentrically relative to the outer beam passing holes of the two electrodes which are disposed upstream and downstream of the middle electrode.

2 Claims, 1 Drawing Sheet

ELECTRON GUN FOR COLOR CATHODE RAY TUBE

FIELD OF THE INVENTION

The present invention relates to an electron gun for color cathode ray tube, and particularly to a multifocusing type electron gun in which one or more unipotential prefocus lenses are included.

BACKGROUND OF THE INVENTION

One of the currently used electron guns is a multifocusing type electron gun in which a unipotential electrostatic lens and a bipotential electrostatic lens are combined as described in Japanese Patent Publication No. Sho-62-58102 and as schematically illustrated in FIG. 1. Such an electron gun has an improved characteristics in spherical aberration and astigmatism over the electron gun having a single lens.

As shown in FIG. 1, in such an electron gun, a unipotential electrostatic lens PFL, which comprises prefocus electrodes G3, G4, and G5*a*, is disposed between a triode which comprises cathodes K, a control electrode G1, and a screen electrode G2, and a main lens MFL.

In such an electron gun, further improvements of performance are still required in focusing characteristics on the screen of the cathode ray tube. Since the aforesaid conventional electron gun includes a unipotential prefocus lens and a bipotential main focus lens, it is likely that beam spots on the screen might be expanded due to strong focusing forces of the above mentioned two focus lenses.

In overcoming the above problem, there is a method such that focusing forces of the prefocus lens are properly weakened through a proper structural modification, so that the incident angle of the electron beam entering the final main focus lens is expanded.

The electron gun having the aforesaid uni-bipotential electrostatic lens is further constituted such that outer electron beams are made to converge into a middle electron beam by an asymmetrical main lens. The asymmetrical lens is formed by outer beam passing holes of a final focusing electrode G5*b* and an anode G6. The outer beam passing hole of anode G6 is disposed outwardly eccentrically relative to the outer beam passing hole of final focusing electrode G5*b*.

In such an electron gun, the electron beams are converged at the final main focus lens which is disposed adjacent the screen of the cathode ray tube. Therefore, it is possible that an astigmatism occurs along the periphery of the screen.

SUMMARY OF THE INVENTION

Therefore it is the object of the present invention to provide a multifocusing type electron gun for a cathode ray tube, in that the above described problems are solved.

In achieving the above object, the electron gun for the cathode ray tube according to the present invention, comprises a prepositioned triode consisting of a cathode, a control electrode and a screen electrode; a bipotential main lens consisting of a main focus electrode and a final accelerating electrode; and a unipotential prefocus lens consisting of two or more electrodes, and disposed between the prepositioned triode and main lens, and is characterized in that, when the unipotential prefocus lens consists of three electrodes, the diameters of the beam passing holes of a middle electrode are greater than the diameters of the beam passing holes of the electrodes which are disposed upstream and downstream of the middle electrode, and the outer beam passing holes of the middle electrode are disposed outwardly eccentrically relative to the outer beam passing holes of the other two electrodes which are disposed upstream and downstream of the middle electrode.

In the multifocusing type electron gun of the present invention constituted as described above, convergence of the electron beams is achieved by both the prefocus lens and main lens, thus reducing the dependence on the main focus lens for converging the electron beams. Therefore, convergence drift along the periphery of the picture is reduced through such a multistep convergence, resulting in an improvement of a picture quality. Further, among the three electrodes forming the unipotential electrostatic lens, the beam passing holes of the middle electrode have a diameter larger than the diameter of the beam passing holes of the two electrodes disposed upstream and downstream of the middle electrode. Therefore, the unipotential electrostatic lens provides weaker focusing forces compared with the conventional lens. Thus, the incident angle of the electron beam at the main focus lens is expanded, resulting that the electron beams which have passed through the main focus lens will form a smaller beam spot.

This is an important factor for determining the resolving power of a cathode ray tube, and therefore, a high resolution picture can be realized.

BRIEF DESCRIPTION OF THE DRAWINGS

The above object and other advantages of the present invention will become more apparent by describing in detail the preferred embodiment of the present invention with reference to the attached drawings.

DESCRIPTION OF THE PREFERRED EMBODIMENT

Figure 2:
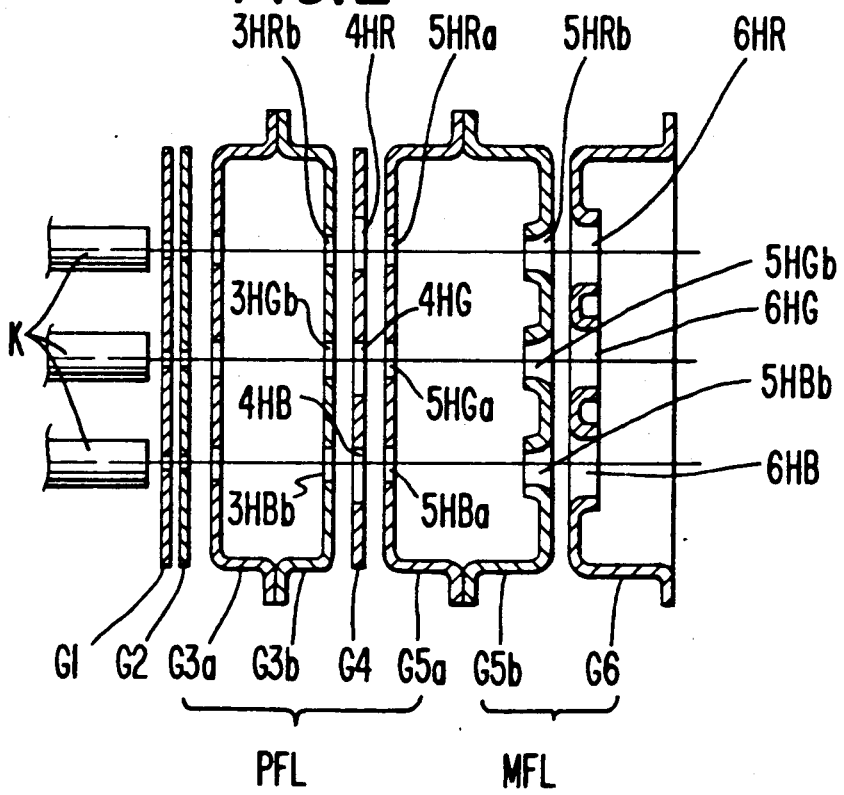
FIG. 2 is a cross sectional view of the electron gun for color cathode ray tube according to the present invention.

As shown in FIG. 2, the electron gun according to the present invention comprises: cathodes K, a control electron G1 and a screen electrode G2, forming a prepositioned triode; electrodes G3*a*, G3*b*, G4, G5*a*, forming a unipotential prefocus lens PFL; and a focus electrode G5*b* and an electrode or anode G6, forming a bipotential main focus lens MFL.

The diameters of beam passing holes 4HR, 4HG, 4HB of electrode G4 of prefocus lens PFL are greater than the diameters of corresponding beam passing holes 3HR*b*, 3HG*b*, 3HB*b*, 5HR*a*, 5HG*a*, 5HB*a* of electrodes G3*b*, G5*a* of prefocus lens PFL, which are disposed upstream and downstream of electrode G4. Further, outer beam passing holes 4HR, 4HB of electrode G4 are disposed outwardly eccentrically relative to outer beam passing holes 3HR*b* and 3HB*b*, of electrode G3*b*, respectively, and 5HR*a*, and 5HB*a* of electrodes G5*a*, respectively.

Figure 1:
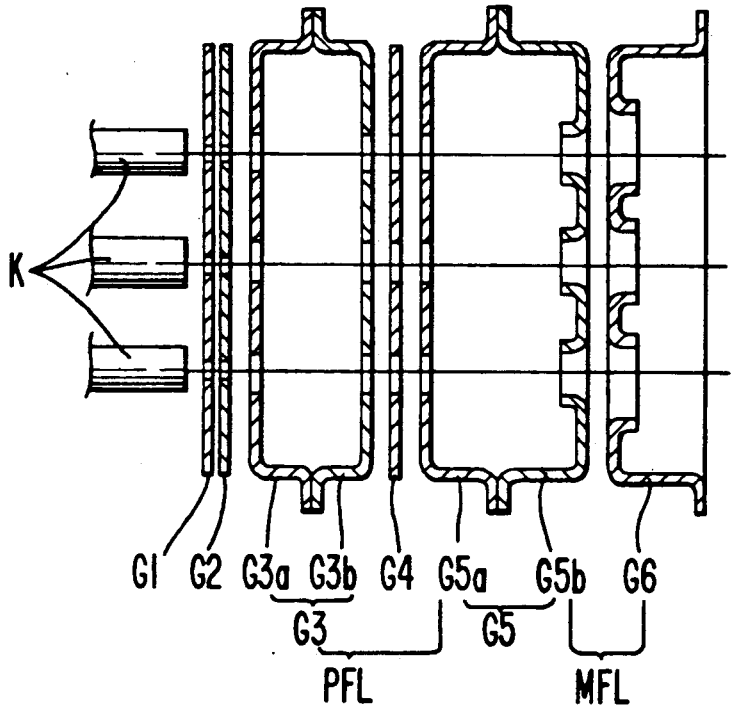
FIG. 1 (PRIOR ART)
FIG. 1 is a cross sectional view of a conventional multistep focusing type electron gun.

Outer beam passing holes GHR, GHB of a final accelerating electrode G6 and outer beam passing holes, 5HR*b*, 5HB*b* of main focus electrode G5*b* of bipotential main lens MFL are disposed concentrically with respect to one another. This feature is different from the structure of the conventional electron gun of FIG. 1.

However, depending on the circumstance, outer beam passing holes 5HR*b*, 5HB*b*, electrode G5*b* and 6HR, 6HB of electrode G6 may be disposed eccentrically with respect to one another as in the conventional electron gun.

The electron gun of the present invention constituted as above will be operated in a manner described below.

Electron beams are generated from the prepositioned triode and pass through prefocus lens PFL. During this passage, the electron beam are preliminarily focused and accelerated by an unipotential electrostatic lens. When outer electron beams pass through an asymmetrical electrostatic lenses which are formed by eccentrically disposed outer beam passing holes, the outer electron beams are converged toward a middle electron beam.

Under this condition, a weak electrostatic lens is formed because the diameters of beam passing holes 4HR, 4HG, 4HB of electrode G4 are greater than the diameters of beam passing holes 3HR*b*, 3HG*b*, 3HB*b* of electrode G3*b*, and 5HR*a*, 5HG*a*, 5HB*a* of electrode G5*a*, which are disposed upstream and downstream of electrode G4. Accordingly, weak focusing forces are applied to the passing electron beams, thus causing to strike main focus lens MFL with a large incident angle. This in turn causes small beam spots to be formed on the screen of cathode ray tube.

According to the present invention, a weak asymmetrical electric field is formed at the unipotential electrostatic lens, so that the outer electron beams are converged during the prefocusing stage with weak focusing forces. The incident angles of the electron beams at the main lens are expanded, so that small beam spots are formed on the screen of cathode ray tube.

Therefore, according to the present invention, dependence on the main focus lens for convergence of the electron beams is reduced because the electron beams are already partially converged during the prefocusing stage. As a result, depending on the conditions, the outer beam passing holes which form the main lenses can be disposed concentrically with respect to one another to allow the outer lenses of the main lenses to be formed in a symmetrical contour, as shown in FIG. 2. Further, even in the case where the convergence function of the main lens is left intact, the eccentricity of the beam passing holes can be reduced.

Therefore, according to the present invention, the degree of misconvergence which can occur due to variations in voltages applied to the electrodes is significantly reduced, thus providing that performance of the cathode ray tube is stabilized, and a high quality picture is expected through reduction in size of the beam spots on the screen.

What is claimed is:

1. An electron gun for a cathode ray tube, comprising:

means for generating a plurality of electron beams;

prefocus means, coupled to said generating means, for prefocusing generated electron beams, said prefocus means including first and second electrodes, and a third electrode disposed between the first and second electrodes, each electrode corresponding to a respective one of the plurality of electron beams, each electrode including first second, and third electron beam passing holes, the third beam passing hole disposed between the first and second beam passing holes, each of the first and second beam passing holes of the third electrode is disposed eccentricity outwardly relative to a respective one of the first and second beam passing holes of the first and second electrodes, the diameter of said each beam passing hole of the third electrode is greater than the diameter of said respective beam passing hole of the first and second electrodes; and main focus means, coupled to said prefocus means, for focusing prefocused electron beams, said main focus means including a main focus electrode and an anode disposed adjacent the main focus electrode, each of the main focus electrode and the anode having first and second electron beam passing holes, and a third electron beam passing hole disposed between the first and second beam passing holes.

2. The electron gun of claim 1, wherein each of the first and second beam passing holes of the main focus electrode is aligned with a respective one of the first and second beam passing holes of the anode.

* * * * *